United States Patent [19]

Wens et al.

[11] 4,045,301

[45] Aug. 30, 1977

[54] ELECTROLYTIC DEPOSITION OF METALS

[75] Inventors: Karel Wens; Hubert Tobback; Karel Hens, all of Olen, Belgium

[73] Assignee: Metallurgie Hoboken-Overpelt, Brussels, Belgium

[21] Appl. No.: 616,478

[22] Filed: Sept. 24, 1975

[30] Foreign Application Priority Data

Oct. 8, 1974 Luxembourg ..... 71072

[51] Int. Cl.[2] ..... C25D 1/20; C25D 1/04

[52] U.S. Cl. ..... 204/12; 204/281

[58] Field of Search ..... 204/12, 208, 274, 281

[56] References Cited

U.S. PATENT DOCUMENTS

| | | | |
|---|---|---|---|
| 440,548 | 11/1890 | Elmore et al. | 204/12 |
| 3,689,396 | 9/1972 | Casagrande et al. | 204/12 |
| 3,779,872 | 12/1973 | Bomberger | 204/12 |
| 3,883,403 | 5/1975 | Ettel et al. | 204/12 |

*Primary Examiner*—T. M. Tufariello

*Attorney, Agent, or Firm*—Fred Philpitt

[57] ABSTRACT

A process for separating an electrolytic deposit of metal from a cathode, in which the bath-level edge of the said electrolytic deposit is locally heated at a plurality of spots to form local gaps between the said edge and the cathode, then the local gaps are enlarged by means of knives so as to unite them together and to form a large gap along the said edge, and then a wedge is operated from the said large gap to separate the entire deposit.

11 Claims, 1 Drawing Figure

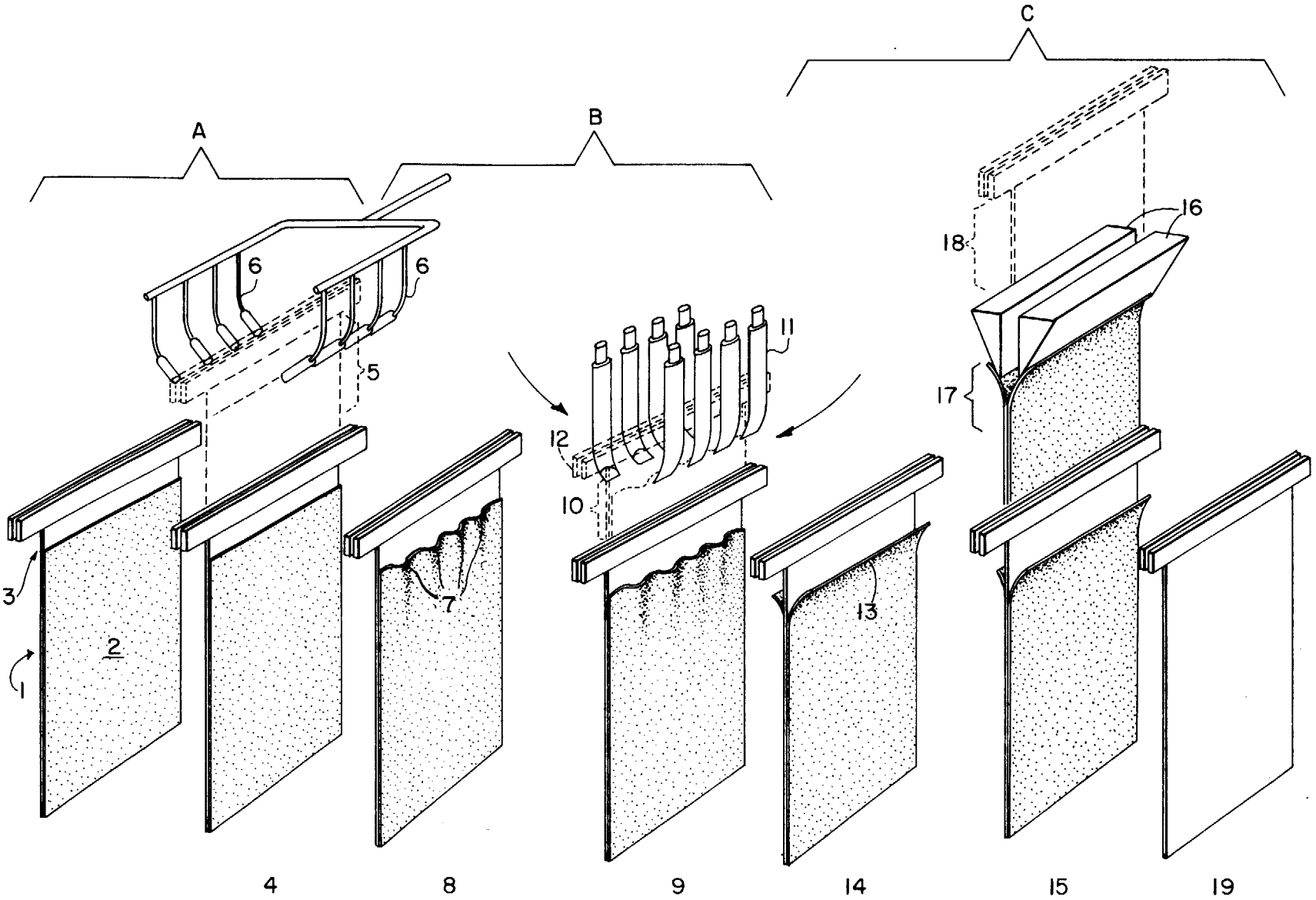
A
B
C
1
2
3
4
5
6
6
7
8
9
10
11
12
13
14
15
16
17
18
19

ELECTROLYTIC DEPOSITION OF METALS

This invention relates to a process for separating an electrolytic deposit of metal, more especially of copper or copper alloy, from a cathode.

The process according to the invention is particularly suited for separating electrolytic deposits which may be used subsequently as starting sheets in the electrorefining of metals, or which may be transformed into semi-finished products by smelting and casting.

Until now, the separation of electrolytic deposits from cathodes was carried out manually, although various attempts have been made to mechanize that work.

For instance, it has already been proposed to carry out the said separation automatically by centering, rolling, by the use of water jets, wedges or knives, by suction, by shock waves, by impulsions from magnetic fields, or by fixation of ears on the deposit following by a pulling operation on said ears. Some of these proposals has foreseen a preliminary stripping by mechanical shocks or by knives of at least part of the upper edge of the deposit that must be stripped.

It has been recently proposed to keep the cathode with its deposit at a predetermined temperature between its exit from the electrolytic cell and a separation station, to seize the deposit inside said station with suction-grips, to modify quickly the temperature of the deposit and to move the suction-grips so as to remove the deposit.

Another recent proposal concerns the use of a titanium cathode the width of which tapers downwards. When the said cathode has received a deposit of metal such as copper, the said deposit is heated so that it expands to a greater extent than the cathode after which the deposit may be slipped off the cathode.

It has also been proposed to separate a copper deposit from a titanium cathode by first cooling the set rapidly, for example by cooling in cold water, and to heat it subsequently, for example by immersion in hot water.

These proposals of the prior art present at least one of the following drawbacks: to require the use of complicated apparatus; subjection of the apparatus to severe mechanical strains; lack of reliability, especially when using suction-grips and during the separation by purely thermal means: risks of damaging the cathode.

The object of the present invention is to avoid the drawbacks of the prior art.

The present invention consists in a process for separating an electrolytic deposit of metal from a cathode, in which the bath-level edge of the said electrolytic deposit is locally heated at a plurality of spots to form local gaps between the said edge and the cathode, then the local gaps are enlarged by means of knives so as to unite them together and to form a large gap along the said edge, and then a wedge is operated from the said large gap to separate the entire deposit.

The expression "metal" used in this specification includes "metal alloy".

Advantageously, the bath-level edge of the deposit is locally heated by means of flames, such as those produced by combustion of a gas. It is also possible to heat by radiation or induction.

In order to enlarge the local gaps by means of knives, it is advantageous to keep the knives motionless and to lift the cathode relatively to the knives.

In order to achieve the separation by means of a wedge, the wedge is preferably kept motionless and the cathode is lifted relatively to the wedge.

The cathode is preferably made of rolled copper or titanium, or of a titanium alloy or of stainless steel.

The process of the invention is advantageously used for separating electrolytic deposits of copper which may be used as starting sheets in the electrorefining of copper, or be transformed into semi-finished products by smelting and casting.

The assignee Company however waives the protection for the separation of zinc and cadmium electrodeposits.

The invention will be better understood from the description given hereinafter of an equipment for carrying out the process of the invention and which is given as a non-limitating example and is illustrated by the companying drawing.

Referring to the accompanying drawing, the equipment for stripping the cathodes of their electrolytic deposit consists mainly: of a first station A where the bath-level edge of the deposit is partially detached by means of flames; of a second station B where the said edge is completely separated by means of knives; of a station C where the stripping is achieved by means of wedges; and means known "per se", but not represented, for conveying the cathodes to be stripped to stations A, B and C, for lifting and lowering the cathodes at the said stations and for removing the stripped cathodes and the removed deposits from the station C.

The reference numeral 1 shows the cathode to be stripped being conveyed to the station A. Both faces of the cathode 1 are covered by electrolysis with a copper deposit 2 of about 0.5 to 1 mm thick, having a bath-level edge 3. Such a deposit may advantageously be used subsequently as a starting sheet in the electro-refining of copper.

When the cathode 1 arrives at 4 at the station A, it is lifted about 30 cm so as to occupy the position 5 represented by dashed lines wherein the upper part of the cathode is located between two rows of four gasburners 6 which are directed against the bath-level edge of the copper deposit. The local heating of the said edge of the deposit for a few seconds produces a separation or stripping at a plurality of spots, as illustrated at 7. After this operation the cathode is lowered again in the position 4 previously mentioned, and is conveyed to the station B as shown at 8.

At 9, at the station B, the cathode is lifted by about 30 cm and comes at 10 between two series of four knives 11 arranged in the same way as the burners of the station A with respect to the cathode. By a pivoting operation, as indicated by the arrows, the knives place themselves on both sides of the cathode between the suspension bar 12 of the cathode and the partially detached spots 7 of the bath-level edge of the deposit. The lifting motion of the cathode is now continued for about 10 cm and the knives detach the entire bath-level edge of the deposit over a corresponding height, as shown at 13, by entering the gaps 7 formed at the station A. Afterwards, the knives are disengaged by pivoting them back, and the cathode is lowered in the position 9, and conveyed to the station C as shown at 14.

On arriving at 15 at the station C, the cathode is lift about 20 to 30 cm so as to allow two wedges 16, one on each side, to be inserted between the cathode and edge 13 detached at the station B, as shown at 17. The cathode is then lifted further, through its full height, as shown at 18, until its lower edge has reached the lower level of the wedges 16, so that the deposits are completely detached from the cathode. By means known per se, but not represented, the two removed deposits are lifted and removed. The cathode is lowered in the position 15 and is removed as shown at 19.

An equipment as described above may have a capacity of 450 cathodes per hour.

What is claim is:

1. A process for separating an electrolytic deposit of metal from a cathode, in which the bath-level edge of the said electrolytic deposit is locally heated at a plurality of spots so as to form a plurality of spaced apart gaps between the said edge and the cathode, then the plurality of spaced apart gaps are enlarged by means of a plurality of spaced apart knives so as to unite the plurality of spaced apart gaps into a large gap along the said edge, and then a wedge is operated from the said large gap to separate the entire deposit from the cathode.

2. A process as claimed in claim 1, which is applied to electrolytic deposits of copper or copper alloy.

3. A process as claimed in claim 1, in which the heating is carried out with the use of flames.

4. A process as claimed in claim 1, in which the heating is carried out by radiation.

5. A process as claimed in claim 1, in which the heating is carried out by induction.

6. A process as claimed in claim 1, in which, in order to enlarge (the local) gaps by means of knives, the said knives are kept motionless and the cathode is lifted relatively to the knives.

7. A process as claimed in claim 1, in which the separation is achieved by utilizing a wedge which is kept motionless and the cathode is lifted relatively to the wedge.

8. A process as claimed in claim 1, in which the cathode is made of rolled copper or titanium or of titanium alloy or stainless steel.

9. A process as claimed in claim 1, in which the metal deposit separated from the cathode is used as a starting sheet for electro-refining.

10. A process as claimed in claim 1, in which the metal deposit separated from the cathode is transformed into semi-finished products by smelting and casting.

11. An equipment for stripping an electrolytic deposit from each face of a cathode, which comprises a first station provided with a plurality of gas burners positioned above the bath-level edge at a plurality of spots, a second station provided with a plurality of pivotally mounted knives positioned above said bath level edge, a third station provided with wedges positioned above said bath level edge and means for conveying the cathode to be stripped successively to said stations, means for lifting and lowering the cathode at each station, and means for removing the stripped cathode and the detached deposit from the third station.

* * * * *